US011497374B2

(12) United States Patent
Boyer

(10) Patent No.: US 11,497,374 B2
(45) Date of Patent: Nov. 15, 2022

(54) DISHWASHER WITH WALL-MOUNTED ROTATABLE CONDUIT

(71) Applicant: Midea Group Co., Ltd., Foshan (CN)

(72) Inventor: Joel Boyer, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 289 days.

(21) Appl. No.: 16/795,484

(22) Filed: Feb. 19, 2020

(65) Prior Publication Data

US 2021/0251462 A1 Aug. 19, 2021

(51) Int. Cl.
*A47L 15/22* (2006.01)
*A47L 15/42* (2006.01)

(52) U.S. Cl.
CPC ..... *A47L 15/22* (2013.01); *A47L 15/428* (2013.01); *A47L 15/4217* (2013.01)

(58) Field of Classification Search
CPC ..... A47L 15/0076; A47L 15/0078; A47L 15/0081; A47L 15/0092; A47L 15/18; A47L 15/22; A47L 15/23; A47L 15/4221; A47L 15/4278; A47L 15/428; A47L 15/4282
See application file for complete search history.

(56) References Cited

U.S. PATENT DOCUMENTS 2,734,520 A 2/1956 Abresch
2,808,063 A 10/1957 Abresch et al.
2,907,335 A 10/1959 Abresch
2,992,779 A 1/1960 James et al.
2,939,465 A 6/1960 Kesling
2,956,572 A 10/1960 Levit et al.
2,973,907 A 3/1961 Abresch et al.
2,980,120 A 4/1961 Jacobs
3,006,557 A 10/1961 Jacobs
3,026,046 A 3/1962 Wickham et al.
3,044,842 A 7/1962 Abresch et al.
3,051,183 A 8/1962 Jacobs
3,077,200 A 2/1963 Guth
3,082,779 A 3/1963 Jacobs
3,088,474 A 5/1963 Leslie
3,101,730 A 8/1963 Harris et al.
3,115,306 A 12/1963 Graham
(Continued)

FOREIGN PATENT DOCUMENTS

CN 2094961 U 2/1992
CN 2395683 Y 9/2000
(Continued)

OTHER PUBLICATIONS

Transmittal of Related Applications dated Apr. 4, 2022.
(Continued)

*Primary Examiner* — David G Cormier
(74) *Attorney, Agent, or Firm* — Middleton Reutlinger

(57) ABSTRACT

A dishwasher, dishwasher sprayer, and method for assembling the same utilize a rotatable conduit that is supported in a cantilevered fashion on a wash tub wall of the dishwasher. The rotatable conduit may be supported within a conduit support and may project through an aperture in the conduit support, and may include a shoulder portion that inhibits axial movement of the rotatable conduit within the conduit support.

18 Claims, 8 Drawing Sheets

(56) References Cited

U.S. PATENT DOCUMENTS 3,178,117 A 4/1965 Hanifan
3,192,935 A 7/1965 Hanifan
3,210,010 A 10/1965 Delapena
3,324,867 A 6/1967 Freese
3,348,775 A 10/1967 Flame
3,361,361 A 1/1968 Schutte
3,454,784 A 7/1969 Wantz et al.
3,538,927 A 11/1970 Harald
3,586,011 A 6/1971 Mazza
3,590,688 A 7/1971 Brannon
3,596,834 A 8/1971 Cushing
3,719,323 A 3/1973 Raiser
3,827,637 A 8/1974 Stephany et al.
3,854,665 A 12/1974 Rodgers
4,123,006 A 10/1978 Yukishita
4,175,575 A 11/1979 Cushing
4,226,490 A 10/1980 Jenkins et al.
4,301,822 A 11/1981 Dingler
4,398,562 A 8/1983 Saarem et al.
4,657,188 A 4/1987 Crane et al.
4,718,440 A 1/1988 Hawker et al.
4,732,323 A 3/1988 Jarvis et al.
4,822,241 A 4/1989 Jarvis et al.
5,098,020 A 3/1992 Cooper et al.
5,211,190 A 5/1993 Johnson et al.
5,226,454 A 7/1993 Cabalfin
5,341,827 A 8/1994 Kim
5,511,727 A 4/1996 Heren et al.
5,697,392 A 12/1997 Johnson et al.
5,725,002 A 3/1998 Payzant
5,752,533 A 5/1998 Edwards
5,759,647 A 6/1998 Kuroda et al.
5,927,616 A 7/1999 Grise et al.
6,053,185 A 3/2000 Cirjak et al.
6,431,188 B1 8/2002 Laszczewski, Jr. et al.
6,612,009 B1 9/2003 Laszczewski, Jr. et al.
6,694,990 B2 2/2004 Spanyer et al.
6,869,029 B2 3/2005 Ochoa et al.
6,955,742 B2 10/2005 McKay et al.
7,055,537 B2 6/2006 Elick et al.
7,182,562 B2 2/2007 Botosan et al.
7,210,315 B2 5/2007 Castelli et al.
7,252,246 B2 8/2007 Heren et al.
7,258,286 B1 8/2007 Wang et al.
7,293,435 B2 11/2007 Elexpuru et al.
7,445,013 B2 11/2008 VanderRoest et al.
7,464,718 B2 12/2008 McIntyre et al.
7,556,049 B2 7/2009 Oakes et al.
7,587,916 B2 9/2009 Rizzetto
7,594,513 B2 9/2009 VanderRoest et al.
7,607,325 B2 10/2009 Elexpuru et al.
7,650,765 B2 1/2010 Rizzetto
7,914,625 B2 3/2011 Bertsch et al.
7,935,194 B2 5/2011 Rolek
8,136,537 B2 3/2012 Cerrano et al.
8,161,995 B2 4/2012 Armstrong et al.
8,191,560 B2 6/2012 Mallory et al.
8,443,765 B2 5/2013 Hollis
8,696,827 B2 4/2014 Ashrafzadeh et al.
8,778,094 B2 7/2014 Blanchard et al.
8,858,729 B2 10/2014 Buddharaju et al.
8,900,375 B2 12/2014 Gnadinger et al.
8,915,257 B2 12/2014 Büsing et al.
8,932,411 B2 1/2015 Beaudet et al.
8,978,674 B2 3/2015 Buesing
8,985,128 B2 3/2015 Pyo et al.
9,121,217 B1 9/2015 Hoffberg
9,170,584 B2 10/2015 Lum et al.
9,199,286 B2 12/2015 Jendrichowski et al.
9,204,780 B2 12/2015 Francisco et al.
9,220,393 B2 12/2015 Becker et al.
9,241,604 B2 1/2016 Dries
9,259,137 B2 2/2016 Boyer et al.
9,265,400 B2 2/2016 Bigott
9,307,888 B2 4/2016 Baldwin et al.
9,326,657 B2 5/2016 Thiyagarajan
9,480,389 B2 11/2016 Haft et al.
9,492,055 B2 11/2016 Feddema
9,532,700 B2 1/2017 Welch
9,635,994 B2 5/2017 Boyer et al.
9,655,496 B2 5/2017 Baldwin et al.
9,915,356 B2 3/2018 Chang et al.
9,958,073 B2 5/2018 Yang
10,524,634 B2 1/2020 Digman
10,531,781 B2 1/2020 Digman et al.
10,631,708 B2 4/2020 Digman et al.
10,765,291 B2 9/2020 Digman et al.
2005/0011544 A1 1/2005 Rosenbauer et al.
2005/0139240 A1 6/2005 Bong et al.
2005/0241680 A1 11/2005 Noh
2005/0241681 A1 11/2005 Hwang
2006/0090778 A1 5/2006 Oakes et al.
2006/0278258 A1 12/2006 Kara et al.
2007/0215187 A1 9/2007 Koch
2008/0163904 A1 7/2008 Hwang
2008/0271765 A1 11/2008 Burrows
2008/0276975 A1 11/2008 Disch
2009/0071508 A1 3/2009 Sundaram et al.
2009/0090400 A1 4/2009 Burrows et al.
2009/0145468 A1 6/2009 Chericoni
2010/0043826 A1 2/2010 Bertsch et al.
2011/0186085 A1 8/2011 Chen et al.
2012/0060875 A1 3/2012 Fauth et al.
2012/0175431 A1 7/2012 Althammer et al.
2012/0291827 A1 11/2012 Buddharaju et al.
2013/0000762 A1 1/2013 Buddharaju et al.
2013/0068265 A1 3/2013 Gnadinger et al.
2013/0137621 A1 5/2013 Kessler et al.
2013/0319483 A1 12/2013 Welch
2014/0059880 A1 3/2014 Bertsch et al.
2014/0069470 A1 3/2014 Baldwin et al.
2014/0345654 A1* 11/2014 Cho ..... A47L 15/23 134/172
2014/0373876 A1 12/2014 Feddema
2015/0007861 A1 1/2015 Azmi et al.
2015/0266065 A1 9/2015 Savoia
2016/0058264 A1 3/2016 Thiyagarajan
2016/0198928 A1 7/2016 Xu et al.
2017/0135548 A1 5/2017 Swarnkar
2017/0181599 A1 6/2017 Choi et al.
2017/0224190 A1 8/2017 Sakthivel et al.
2017/0265707 A1 9/2017 Roderick et al.
2017/0273535 A1 9/2017 Roderick et al.
2017/0354308 A1 12/2017 Choi et al.
2018/0035863 A1 2/2018 Liu et al.
2018/0084967 A1 3/2018 Ross et al.
2018/0110397 A1 4/2018 Kim et al.
2018/0132692 A1 5/2018 Dries
2018/0168425 A1 6/2018 Wilson et al.
2018/0192851 A1 7/2018 Gursoy et al.
2018/0220870 A1 8/2018 Beshears, Jr. et al.
2018/0333037 A1 11/2018 Roderick et al.
2018/0360293 A1 12/2018 Boyer
2019/0059688 A1 2/2019 Woo et al.
2019/0099054 A1 4/2019 Digman et al.
2019/0099056 A1 4/2019 Digman
2019/0191959 A1 6/2019 Brightbill et al.
2019/0290095 A1 9/2019 Wahlberg et al.
2019/0307308 A1 10/2019 Haegermarck
2020/0077868 A1 3/2020 Digman et al.
2020/0085277 A1 3/2020 Digman et al.
2020/0085278 A1 3/2020 Digman et al.
2020/0085279 A1 3/2020 Digman et al.
2020/0107696 A1 4/2020 Digman et al.
2020/0288940 A1 9/2020 Fawaz et al.
2021/0267430 A1 9/2021 Digman et al.
2022/0087500 A1 3/2022 Boyer et al.

FOREIGN PATENT DOCUMENTS

CN 1879547 A 12/2006
CN 101049224 A 10/2007
CN 101134198 A 3/2008
CN 201067392 Y 6/2008

(56) References Cited

FOREIGN PATENT DOCUMENTS

| | | | |
|---|---|---|---|
| CN | 101795613 | A | 8/2010 |
| CN | 102307508 | A | 1/2012 |
| CN | 102370450 | A | 3/2012 |
| CN | 102512128 | A | 6/2012 |
| CN | 102940476 | A | 2/2013 |
| CN | 203447254 | U | 2/2014 |
| CN | 203749364 | U | 8/2014 |
| CN | 203763025 | U | 8/2014 |
| CN | 104433985 | A | 3/2015 |
| CN | 104523208 | A | 4/2015 |
| CN | 104757921 | A | 7/2015 |
| CN | 104840165 | A | 8/2015 |
| CN | 204671085 | U | 9/2015 |
| CN | 105147218 | A | 12/2015 |
| CN | 105147220 | A | 12/2015 |
| CN | 105231971 | A | 1/2016 |
| CN | 205094364 | U | 3/2016 |
| CN | 106224508 | A | 12/2016 |
| CN | 106574786 | A | 4/2017 |
| CN | 105286746 | B | 2/2018 |
| CN | 108697298 | A | 10/2018 |
| CN | 109124522 | A | 1/2019 |
| CN | 109236874 | A | 1/2019 |
| CN | 109538865 | A | 3/2019 |
| CN | 110578787 | B | 1/2021 |
| DE | 3537184 | A1 | 4/1987 |
| DE | 20113227 | U1 | 10/2001 |
| DE | 10121083 | A1 | 10/2002 |
| DE | 10300501 | A1 | 7/2004 |
| DE | 202004013786 | U1 | 12/2004 |
| DE | 102008011743 | A1 | 9/2009 |
| DE | 202014010365 | U1 | 5/2015 |
| EP | 0368096 | A2 | 5/1990 |
| EP | 0559466 | A1 | 9/1993 |
| EP | 0679365 | A1 | 11/1995 |
| EP | 0764421 | A1 | 3/1997 |
| EP | 0786231 | A2 | 7/1997 |
| EP | 0826427 | A2 | 3/1998 |
| EP | 0864291 | A1 | 9/1998 |
| EP | 1132038 | A2 | 9/2001 |
| EP | 1136030 | A1 | 9/2001 |
| EP | 1238622 | A2 | 9/2002 |
| EP | 1252856 | A2 | 10/2002 |
| EP | 1632166 | A2 | 3/2006 |
| EP | 1758494 | A1 | 3/2007 |
| EP | 2452759 | A1 | 5/2012 |
| EP | 2636786 | A1 | 9/2013 |
| EP | 2059160 | B1 | 3/2015 |
| EP | 3222191 | A1 | 9/2017 |
| FR | 1473796 | A | 3/1967 |
| GB | 572623 | A | 10/1945 |
| GB | 2244209 | A | 11/1991 |
| JP | 2003339607 | A | 12/2003 |
| JP | 2014121353 | A | 7/2014 |
| KR | 100786069 | B1 | 12/2007 |
| KR | 200442414 | Y1 | 11/2008 |
| KR | 101173691 | B1 | 8/2012 |
| KR | 200464747 | Y1 | 1/2013 |
| WO | 2009008827 | A1 | 1/2009 |
| WO | 2016008699 | A1 | 1/2016 |
| WO | 2017022974 | A1 | 2/2017 |
| WO | 2018053635 | A1 | 3/2018 |
| WO | 2018107833 | A1 | 6/2018 |
| WO | 2018107834 | A1 | 6/2018 |
| WO | 2018107835 | A1 | 6/2018 |

OTHER PUBLICATIONS

Boyan Manufacturing Solutions, Custom Plastic Helical Gears, Retrieved on Jul. 1, 2020.

Gardiner, Ginger, Injection-Forming for High-Performance, Unitized Thermoplastic Structures, CompositesWorld, Jul. 30, 2019.

International Search Report and Written Opinion issued in Application No. PCT/CN2021/110530, dated Oct. 27, 2021, 10 pages.

U.S. Patent and Trademark Office, Final Office Action issued in U.S. Appl. No. 16/132,106 dated Jan. 7, 2021.

Transmittal of Related Applications.

Electrolux Home Products, Inc. "Dishwasher Use & Care Guide 1500 Series with Fully Electronic Control" 2003.

Scribd, Sears Kenmore Elite 2013 Stainless Steel Tall Tub Dishwasher Service Manual, www.scribd.com, Retrieved on Dec. 5, 2018.

Everyspec, Federal Specification: Dishwashing Machines, Single Tank and Double Tank, Commercial, www.everyspec.com, Oct. 17, 1983.

DE10121083A1 machine translation (Year: 2002).

International Search Report and Written Opinion issued in Application No. PCT/CN2021/110536 dated Oct. 26, 2021.

Encyclo, "Keyed Connector—Definition—Encyclo", https://www.encyclo.co.uk/meaning-of-Keyed_connectors, 2020.

International Search Report and Written Opinion issued in Application No. PCT/CN2020/108004 dated Oct. 26, 2020.

European Patent Office, Communication issued in Application No. 19859390.7, 9 pages, dated Aug. 24, 2021.

* cited by examiner

DISHWASHER WITH WALL-MOUNTED ROTATABLE CONDUIT

BACKGROUND

Dishwashers are used in many single-family and multi-family residential applications to clean dishes, silverware, cutlery, cups, glasses, pots, pans, etc. (collectively referred to herein as "utensils"). Many dishwashers rely primarily on rotatable spray arms that are disposed at the bottom and/or top of a tub and/or are mounted to a rack that holds utensils. A spray arm is coupled to a source of wash fluid and includes multiple apertures for spraying wash fluid onto utensils, and generally rotates about a central hub such that each aperture follows a circular path throughout the rotation of the spray arm. The apertures may also be angled such that force of the wash fluid exiting the spray arm causes the spray arm to rotate about the central hub.

While traditional spray arm systems are simple and mostly effective, they have the shortcoming that they must spread the wash fluid over all areas equally to achieve a satisfactory result. In doing so, resources such as time, energy and water are generally wasted because wash fluid cannot be focused precisely where it is needed. Moreover, because spray arms follow a generally circular path, the corners of a tub may not be covered as thoroughly, leading to lower cleaning performance for utensils located in the corners of a rack. In addition, in some instances the spray jets of a spray arm may be directed to the sides of a wash tub during at least portions of the rotation, leading to unneeded noise during a wash cycle.

SUMMARY

The herein-described embodiments address these and other problems associated with the art by providing a dishwasher, dishwasher sprayer, and method for assembling the same utilizing a rotatable conduit that is supported in a cantilevered fashion on a wash tub wall of the dishwasher. The rotatable conduit may be supported within a conduit support and may project through an aperture in the conduit support, and may include a shoulder portion that inhibits axial movement of the rotatable conduit within the conduit support.

Therefore, consistent with one aspect of the invention, a dishwasher may include a wash tub, a rotatable conduit being rotatable about a longitudinal axis thereof and including a shoulder disposed proximate a first end thereof, and a conduit support disposed on a wall of the wash tub and configured to support the rotatable conduit on the wall of the wash tub in a cantilevered fashion. The conduit support may include a fluid inlet in fluid communication with a fluid supply and configured to communicate fluid from the fluid supply to the rotatable conduit, the conduit support may include an aperture through which the rotatable conduit projects, and the conduit support may be configured to retain the shoulder of the rotatable conduit within the housing to inhibit axial movement of the rotatable conduit within the conduit support.

In some embodiments, the rotatable conduit includes a metal tube and the shoulder is defined by a flared end of the metal tube. Also, in some embodiments, the flared end is flared about 45 degrees from the longitudinal axis of the rotatable conduit. Further, in some embodiments, the rotatable conduit further includes a plug disposed in the flared end of the metal tube.

In some embodiments, the conduit support includes a bearing arrangement configured to rotatably support the rotatable conduit proximate the first end thereof. In addition, in some embodiments, the bearing arrangement is a first bearing arrangement, and the conduit support includes a second bearing arrangement axially separated from the first bearing arrangement along the longitudinal axis. In some embodiments, each of the first and second bearing arrangements includes a rolling element bearing. In addition, in some embodiments, each of the first and second bearing arrangements includes a bearing surface. Moreover, in some embodiments, the first bearing arrangement includes a rolling element bearing and the second bearing arrangement includes a bearing surface.

In some embodiments, the rotatable conduit further includes a valve body having a radially-facing inlet in fluid communication with an internal channel of the rotatable conduit, and the conduit support includes a radially-facing valve member disposed at a predetermined radius from the longitudinal axis to substantially block fluid flow from the inlet of the conduit support to the radially-facing inlet when the rotatable conduit is rotated to a predetermined rotational position about the longitudinal axis. Moreover, in some embodiments, the predetermined rotational position is a first predetermined rotational position, and the conduit support includes a housing having an interior wall disposed proximate the valve body that is radially-separated from the radially-facing inlet when the rotatable conduit is rotated to a second predetermined rotational position about the longitudinal axis to allow fluid flow from the inlet of the conduit support to the radially-facing inlet when the rotatable conduit is rotated to the second predetermined rotational position.

In some embodiments, the housing includes an annular bearing support disposed proximate the aperture and sized to receive a rolling element bearing having an aperture through which the rotatable conduit projects. Also, in some embodiments, the conduit support includes a cover configured to cover and seal a wall-facing opening of the housing. In some embodiments, the annular bearing support is a first annular bearing support and the rolling element bearing is a first rolling element bearing, the cover includes a second annular bearing support configured to receive a second rolling element bearing having an aperture through which the rotatable conduit projects, and the cover inhibits axial movement of the rotatable conduit within the conduit support.

Moreover, in some embodiments, the rotatable conduit includes a substantially cylindrical tube having an inlet port disposed in a sidewall thereof, the valve body includes a cam body having an aperture, and the cam body is interposed between the first and second rolling element bearings with the generally cylindrical tube extending through the apertures thereof. Also, in some embodiments, the rotatable conduit includes a plurality of apertures disposed in a sidewall thereof to spray fluid into the wash tub. In some embodiments, the conduit includes a tubular spray element, and the dishwasher further includes a tubular spray element drive coupled to the rotatable conduit to discretely direct the rotatable conduit to each of a plurality of rotational positions about the longitudinal axis thereof.

Consistent with another aspect of the invention, a dishwasher sprayer may include a rotatable conduit being rotatable about a longitudinal axis thereof and including a shoulder disposed proximate a first end thereof, the rotatable conduit including a plurality of apertures disposed in a sidewall thereof to spray fluid into a wash tub of a dishwasher, and a conduit support configured to support the rotatable conduit on a wall of the wash tub in a cantilevered fashion, the conduit support including a fluid inlet in fluid communication with a fluid supply and configured to communicate fluid from the fluid supply to the rotatable conduit. The conduit support includes an aperture through which the rotatable conduit projects, and the conduit support is configured to retain the shoulder of the rotatable conduit within the housing to inhibit axial movement of the rotatable conduit within the conduit support.

In some embodiments, the rotatable conduit includes a substantially cylindrical tube, the shoulder is defined by a flared end of the substantially cylindrical tube, the conduit support includes a housing having a first annular bearing support, a cover having a second annular bearing support and configured to seal a wall-facing opening of the housing, and a radially-facing valve member disposed at a predetermined radius from the longitudinal axis and at a predetermined rotational position about the longitudinal axis. The dishwasher sprayer further includes a first rolling element bearing received in the first annular bearing support and having an aperture that receives the substantially cylindrical tube and that has a diameter that is smaller than the shoulder of the rotatable conduit, a valve body having a radially-facing inlet and an aperture that receives the substantially cylindrical tube and that has a diameter that is smaller than the shoulder of the rotatable conduit, the valve body in fluid communication with an internal channel of the substantially cylindrical tube and having a radially-facing inlet that, when the substantially cylindrical tube is rotated to the predetermined rotational position, opposes the radially-facing valve member to substantially block fluid flow from the inlet of the conduit support to the internal channel of the substantially cylindrical tube, and a second rolling element bearing received in the second annular bearing support and having an aperture that receives the substantially cylindrical tube and that has a diameter that is smaller than the shoulder of the rotatable conduit.

Consistent with another aspect of the invention, a method of assembling a dishwasher sprayer may include stacking a first rolling element bearing, a valve body, and a second rolling element bearing onto a rotatable conduit having a longitudinal axis such that the first rolling element bearing is disposed closest to a shoulder disposed proximate a first end of the rotatable conduit and the second rolling element bearing is disposed farthest from the shoulder, where the first rolling element bearing has an aperture through which the rotatable conduit projects and having a smaller diameter than the shoulder such that the shoulder inhibits movement of the first rolling element past the shoulder towards the first end of the rotatable conduit, inserting a second end of the rotatable conduit into an aperture of a housing of a conduit support such that the second rolling element bearing is received within an annular bearing support defined in the housing and such that the valve body is disposed opposite a radially-facing valve member that selectively blocks fluid flow to the valve body when the rotatable conduit is rotated to a predetermined rotational position, and securing a cover to the housing such that the first rolling element bearing is received within an annular bearing support defined on the cover and such that axial movement of the rotatable conduit is substantially inhibited.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
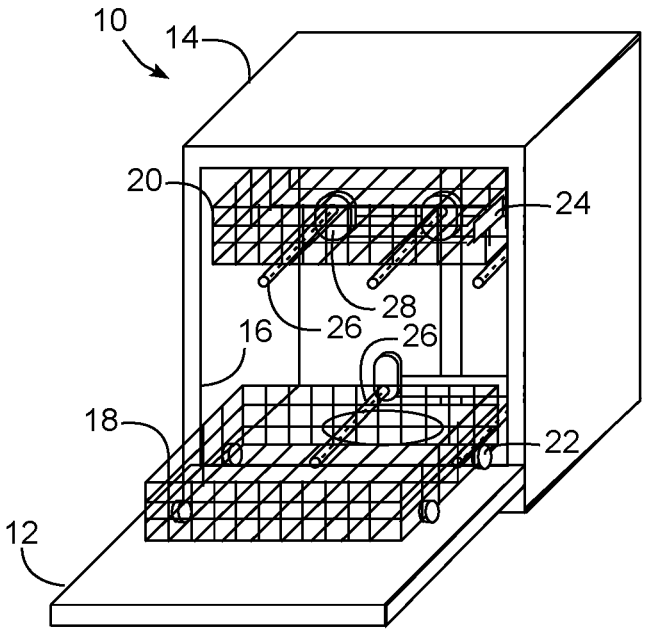
FIG. 1 is a perspective view of a dishwasher consistent with some embodiments of the invention.

In some embodiments consistent with the invention, one or more conduits may be rotatably supported on a wall of a dishwasher in a cantilevered fashion using a conduit support having an aperture through which each rotatable conduit projects. Each rotatable conduit may include a shoulder portion that inhibits axial movement of the rotatable conduit within the conduit support. Further, in some embodiments, the rotatable conduit and conduit support may also incorporate an integrated diverter valve to control the flow of fluid through the conduit based upon a rotational position of the conduit.

A conduit, in this regard, may be considered to be a body capable of communicating a fluid such as water, a wash fluid including water, detergent and/or another treatment composition, or pressurized air. A conduit may communicate fluid to one or more spray elements supported by a rack in some embodiments, while in other embodiments, a conduit itself may include one or more apertures or nozzles such that the conduit also functions as a spray element to spray fluid onto utensils within a wash tub. One particular type of conduit utilized in some embodiments of the invention is referred to herein as a tubular spray element, which may be considered to include an elongated body, which may be generally cylindrical in some embodiments but may also have other cross-sectional profiles in other embodiments, and which has one or more apertures disposed on an exterior surface thereof and in fluid communication with a fluid supply, e.g., through one or more internal passageways defined therein. A tubular spray element also has a longitudinal axis generally defined along its longest dimension and about which the tubular spray element rotates. Further, when a tubular spray element is mounted on a rack and configured to selectively engage with a dock based upon the position of the rack, this longitudinal axis may also be considered to be an axis of insertion. A tubular spray element may also have a cross-sectional profile that varies along the longitudinal axis, so it will be appreciated that a tubular spray element need not have a circular cross-sectional profile along its length as is illustrated in a number embodiments herein. In addition, the one or more apertures on the exterior surface of a tubular spray element may be arranged into nozzles in some embodiments, and may be fixed or movable (e.g., rotating, oscillating, etc.) with respect to other apertures on the tubular spray element. Further, the exterior surface of a tubular spray element may be defined on multiple components of a tubular spray element, i.e., the exterior surface need not be formed by a single integral component.

In addition, in some embodiments a tubular spray element may be discretely directed by a tubular spray element drive to multiple rotational positions about the longitudinal axis to spray a fluid in predetermined directions into a wash tub of a dishwasher during a wash cycle. In some embodiments, the tubular spray element may be operably coupled to such a drive through a support arrangement that both rotates the tubular spray element and supplies fluid to the tubular spray element, as will become more apparent below. Further details regarding tubular spray elements may be found, for example, in U.S. Pat. No. 10,531,781 to Digman et al., which is assigned to the same assignee as that of the present application, and which is incorporated by reference herein.

Dishwasher

Turning now to the drawings, wherein like numbers denote like parts throughout the several views, FIG. 1 illustrates an example dishwasher 10 in which the various technologies and techniques described herein may be implemented. Dishwasher 10 is a residential-type built-in dishwasher, and as such includes a front-mounted door 12 that provides access to a wash tub 16 housed within the cabinet or housing 14. Door 12 is generally hinged along a bottom edge and is pivotable between the opened position illustrated in FIG. 1 and a closed position (not shown). When door 12 is in the opened position, access is provided to one or more sliding racks, e.g., lower rack 18 and upper rack 20, within which various utensils are placed for washing. Lower rack 18 may be supported on rollers 22, while upper rack 20 may be supported on side rails 24, and each rack is movable between loading (extended) and washing (retracted) positions along a substantially horizontal direction. Control over dishwasher 10 by a user is generally managed through a control panel (not shown in FIG. 1) typically disposed on a top or front of door 12, and it will be appreciated that in different dishwasher designs, the control panel may include various types of input and/or output devices, including various knobs, buttons, lights, switches, textual and/or graphical displays, touch screens, etc. through which a user may configure one or more settings and start and stop a wash cycle.

In addition, consistent with some embodiments of the invention, dishwasher 10 may include one or more tubular spray elements (TSEs) 26 to direct a wash fluid onto utensils disposed in racks 18, 20. As will become more apparent below, tubular spray elements 26 are rotatable about respective longitudinal axes and are discretely directable by one or more tubular spray element drives (not shown in FIG. 1) to control a direction at which fluid is sprayed by each of the tubular spray elements. In some embodiments, fluid may be dispensed solely through tubular spray elements, however the invention is not so limited. For example, in some embodiments various upper and/or lower rotating spray arms may also be provided to direct additional fluid onto utensils. Still other sprayers, including various combinations of wall-mounted sprayers, rack-mounted sprayers, oscillating sprayers, fixed sprayers, rotating sprayers, focused sprayers, etc., may also be combined with one or more tubular spray elements in some embodiments of the invention.

Some tubular spray elements 26 may be fixedly mounted to a wall or other structure in wash tub 16, e.g., as may be the case for tubular spray elements 26 disposed below or adjacent lower rack 18. For other tubular spray elements 26, e.g., rack-mounted tubular spray elements, the tubular spray elements may be removably coupled to a docking arrangement such as docking arrangement 28 mounted to the rear wall of wash tub 16 in FIG. 1.

The embodiments discussed hereinafter will focus on the implementation of the hereinafter-described techniques within a hinged-door dishwasher. However, it will be appreciated that the herein-described techniques may also be used in connection with other types of dishwashers in some embodiments. For example, the herein-described techniques may be used in commercial applications in some embodiments. Moreover, at least some of the herein-described techniques may be used in connection with other dishwasher configurations, including dishwashers utilizing sliding drawers or dish sink dishwashers, e.g., a dishwasher integrated into a sink.

Figure 2:
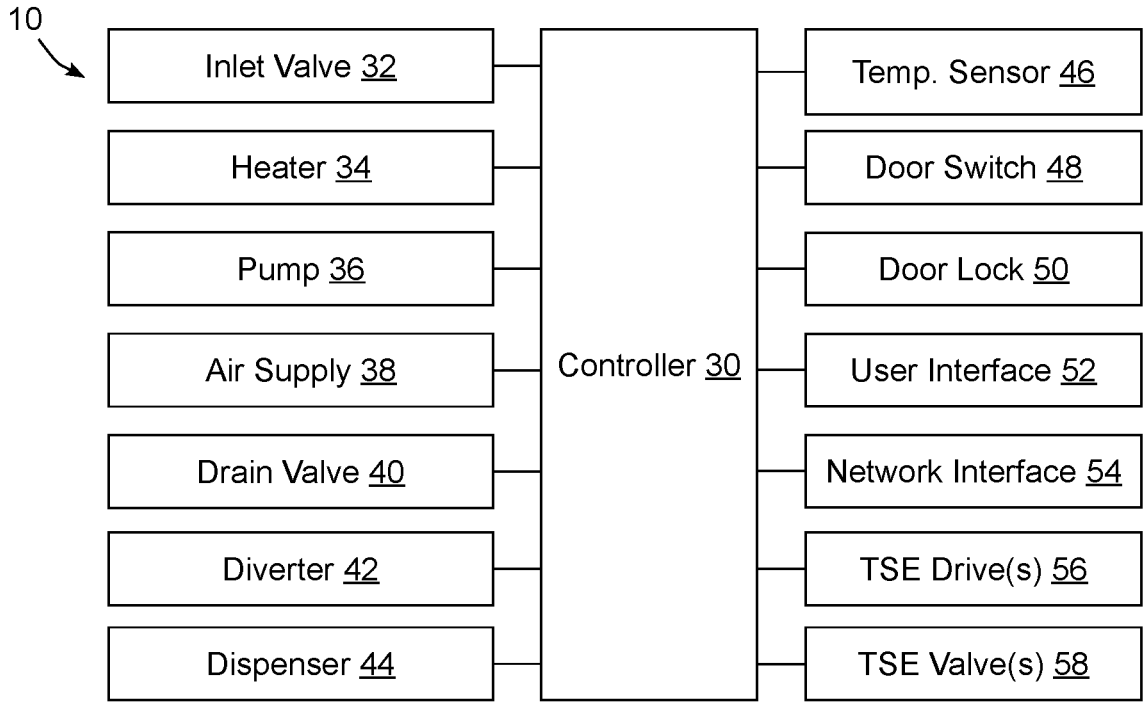
FIG. 2 is a block diagram of an example control system for the dishwasher of FIG. 1.

Now turning to FIG. 2, dishwasher 10 may be under the control of a controller 30 that receives inputs from a number of components and drives a number of components in response thereto. Controller 30 may, for example, include one or more processors and a memory (not shown) within which may be stored program code for execution by the one or more processors. The memory may be embedded in controller 30, but may also be considered to include volatile and/or non-volatile memories, cache memories, flash memories, programmable read-only memories, read-only memories, etc., as well as memory storage physically located elsewhere from controller 30, e.g., in a mass storage device or on a remote computer interfaced with controller 30.

As shown in FIG. 2, controller 30 may be interfaced with various components, including an inlet valve 32 that is coupled to a water source to introduce water into wash tub 16, which when combined with detergent, rinse agent and/or other additives, forms various wash fluids. Controller may also be coupled to a heater 34 that heats fluids, a pump 36 that recirculates wash fluid within the wash tub by pumping fluid to the wash arms and other spray devices in the dishwasher, an air supply 38 that provides a source of pressurized air for use in drying utensils in the dishwasher, a drain valve 40 that is coupled to a drain to direct fluids out of the dishwasher, and a diverter 42 that controls the routing of pumped fluid to different tubular spray elements, spray arms and/or other sprayers during a wash cycle. In some embodiments, a single pump 36 may be used, and drain valve 40 may be configured to direct pumped fluid either to a drain or to the diverter 42 such that pump 36 is used both to drain fluid from the dishwasher and to recirculate fluid throughout the dishwasher during a wash cycle. In other embodiments, separate pumps may be used for draining the dishwasher and recirculating fluid. Diverter 42 in some embodiments may be a passive diverter that automatically sequences between different outlets, while in some embodiments diverter 42 may be a powered diverter that is controllable to route fluid to specific outlets on demand. In still other embodiments, and as will be discussed in greater detail below, each tubular spray element may be separately controlled such that no separate diverter is used. Air supply 38 may be implemented as an air pump or fan in different embodiments, and may include a heater and/or other air conditioning device to control the temperature and/or humidity of the pressurized air output by the air supply.

In the illustrated embodiment, pump 36 and air supply 38 collectively implement a fluid supply for dishwasher 100, providing both a source of wash fluid and pressurized air for use respectively during wash and drying operations of a wash cycle. A wash fluid may be considered to be a fluid, generally a liquid, incorporating at least water, and in some instances, additional components such as detergent, rinse aid, and other additives. During a rinse operation, for example, the wash fluid may include only water. A wash fluid may also include steam in some instances. Pressurized air is generally used in drying operations, and may or may not be heated and/or dehumidified prior to spraying into a wash tub. It will be appreciated, however, that pressurized air may not be used for drying purposes in some embodiments, so air supply 38 may be omitted in some instances. Moreover, in some instances, tubular spray elements may be used solely for spraying wash fluid or spraying pressurized air, with other sprayers or spray arms used for other purposes, so the invention is not limited to the use of tubular spray elements for spraying both wash fluid and pressurized air.

Controller 30 may also be coupled to a dispenser 44 to trigger the dispensing of detergent and/or rinse agent into the wash tub at appropriate points during a wash cycle. Additional sensors and actuators may also be used in some embodiments, including a temperature sensor 46 to determine a wash fluid temperature, a door switch 48 to determine when door 12 is latched, and a door lock 50 to prevent the door from being opened during a wash cycle. Moreover, controller 30 may be coupled to a user interface 52 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 30 may also be coupled to one or more network interfaces 54, e.g., for interfacing with external devices via wired and/or wireless networks such as Ethernet, Bluetooth, NFC, cellular and other suitable networks. Additional components may also be interfaced with controller 30, as will be appreciated by those of ordinary skill having the benefit of the instant disclosure. For example, one or more tubular spray element (TSE) drives 56 and/or one or more tubular spray element (TSE) valves 58 may be provided in some embodiments to discretely control one or more tubular spray elements disposed in dishwasher 10, as will be discussed in greater detail below.

It will be appreciated that each tubular spray element drive 56 may also provide feedback to controller 30 in some embodiments, e.g., a current position and/or speed, although in other embodiments a separate position sensor may be used. In addition, as will become more apparent below, flow regulation to a tubular spray element may be performed without the use of a separately-controlled tubular spray element valve 58 in some embodiments, e.g., where rotation of a tubular spray element by a tubular spray element drive is used to actuate a mechanical valve.

Moreover, in some embodiments, at least a portion of controller 30 may be implemented externally from a dishwasher, e.g., within a mobile device, a cloud computing environment, etc., such that at least a portion of the functionality described herein is implemented within the portion of the controller that is externally implemented. In some embodiments, controller 30 may operate under the control of an operating system and may execute or otherwise rely upon various computer software applications, components, programs, objects, modules, data structures, etc. In addition, controller 30 may also incorporate hardware logic to implement some or all of the functionality disclosed herein. Further, in some embodiments, the sequences of operations performed by controller 30 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the dishwasher illustrated in FIGS. 1-2 will be apparent to one of ordinary skill in the art, as will become apparent from the description below. Therefore, the invention is not limited to the specific implementations discussed herein.

Tubular Spray Elements

Figure 3:
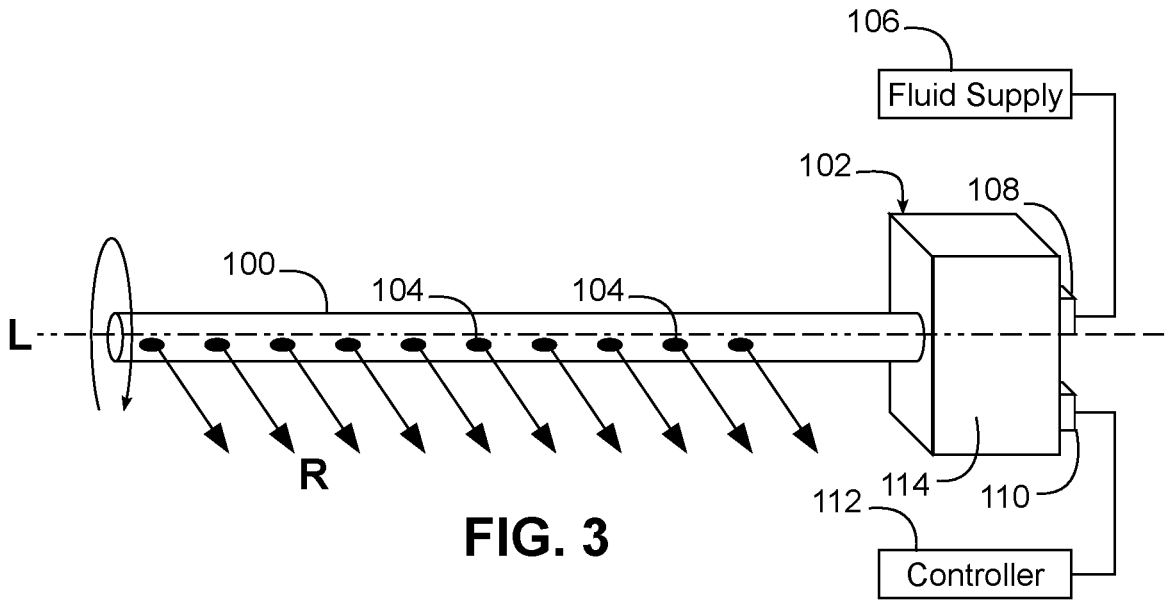
FIG. 3 is a side perspective view of a tubular spray element and tubular spray element drive from the dishwasher of FIG. 1.

Now turning to FIG. 3, in some embodiments, a dishwasher may include one or more discretely directable tubular spray elements, e.g., tubular spray element 100 coupled to a tubular spray element drive 102. Tubular spray element 100 may be configured as a tube or other elongated body disposed in a wash tub and being rotatable about a longitudinal axis L. In addition, tubular spray element 100 is generally hollow or at least includes one or more internal fluid passages that are in fluid communication with one or more apertures 104 extending through an exterior surface thereof. Each aperture 104 may function to direct a spray of fluid into the wash tub, and each aperture may be configured in various manners to provide various types of spray patterns, e.g., streams, fan sprays, concentrated sprays, etc. Apertures 104 may also in some instances be configured as fluidic nozzles providing oscillating spray patterns.

Moreover, as illustrated in FIG. 3, apertures 104 may all be positioned to direct fluid along a same radial direction from axis L, thereby focusing all fluid spray in generally the same radial direction represented by arrows R. In other embodiments, however, apertures may be arranged differently about the exterior surface of a tubular spray element, e.g., to provide spray from two, three or more radial directions, to distribute a spray over one or more arcs about the circumference of the tubular spray element, etc.

Tubular spray element 100 is in fluid communication with a fluid supply 106, e.g., through a port 108 of tubular spray element drive 102, to direct fluid from the fluid supply into the wash tub through the one or more apertures 104. Tubular spray element drive 102 is coupled to tubular spray element 100 and is configured to discretely direct the tubular spray element 100 to each of a plurality of rotational positions about longitudinal axis L. By "discretely directing," what is meant is that tubular spray element drive 102 is capable of rotating tubular spray element 100 generally to a controlled rotational angle (or at least within a range of rotational angles) about longitudinal axis L. Thus, rather than uncontrollably rotating tubular spray element 100 or uncontrollably oscillating the tubular spray element between two fixed rotational positions, tubular spray element drive 102 is capable of intelligently focusing the spray from tubular spray element 100 between multiple rotational positions. It will also be appreciated that rotating a tubular spray element to a controlled rotational angle may refer to an absolute rotational angle (e.g., about 10 degrees from a home position) or may refer to a relative rotational angle (e.g., about 10 degrees from the current position).

Tubular spray element drive 102 is also illustrated with an electrical connection 110 for coupling to a controller 112, and a housing 114 is illustrated for housing various components in tubular spray element drive 102 that will be discussed in greater detail below. In the illustrated embodiment, tubular spray element drive 102 is configured as a base that supports, through a rotary coupling, an end of the tubular spray element and effectively places the tubular spray element in fluid communication with port 108.

By having an intelligent control provided by tubular spray element drive 102 and/or controller 112, spray patterns and cycle parameters may be increased and optimized for different situations. For instance, tubular spray elements near the center of a wash tub may be configured to rotate 360 degrees, while tubular spray elements located near wash tub walls may be limited to about 180 degrees of rotation to avoid spraying directly onto any of the walls of the wash tub, which can be a significant source of noise in a dishwasher. In another instance, it may be desirable to direct or focus a tubular spray element to a fixed rotational position or over a small range of rotational positions (e.g., about 5-10 degrees) to provide concentrated spray of liquid, steam and/or air, e.g., for cleaning silverware or baked on debris in a pan. In addition, in some instances the rotational velocity of a tubular spray element could be varied throughout rotation to provide longer durations in certain ranges of rotational positions and thus provide more concentrated washing in particular areas of a wash tub, while still maintaining rotation through 360 degrees. Control over a tubular spray element may include control over rotational position, speed or rate of rotation and/or direction of rotation in different embodiments of the invention.

Figure 4:
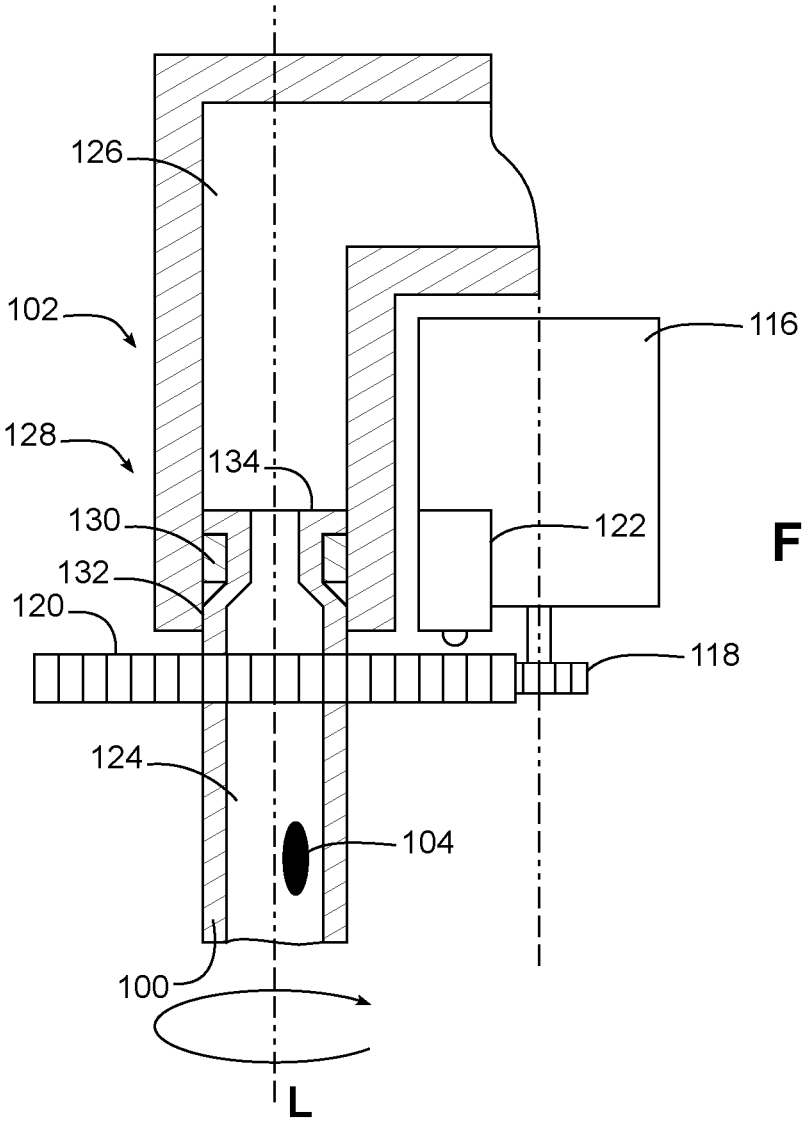
FIG. 4 is a partial cross-sectional view of the tubular spray element and tubular spray element drive of FIG. 3.

FIG. 4 illustrates one example implementation of tubular spray element 100 and tubular spray element drive 102 in greater detail, with housing 114 omitted for clarity. In this implementation, tubular spray element drive 102 includes an electric motor 116, which may be an alternating current (AC) or direct current (DC) motor, e.g., a brushless DC motor, a stepper motor, etc., which is mechanically coupled to tubular spray element 100 through a gearbox including a pair of gears 118, 120 respectively coupled to motor 116 and tubular spray element 100. Other manners of mechanically coupling motor 116 to tubular spray element 100 may be used in other embodiments, e.g., different numbers and/or types of gears, belt and pully drives, magnetic drives, hydraulic drives, linkages, friction, etc.

In addition, an optional position sensor 122 may be disposed in tubular spray element drive 102 to determine a rotational position of tubular spray element 100 about axis L. Position sensor 122 may be an encoder or hall sensor in some embodiments, or may be implemented in other manners, e.g., integrated into a stepper motor, whereby the rotational position of the motor is used to determine the rotational position of the tubular spray element. Position sensor 122 may also sense only limited rotational positions about axis L (e.g., a home position, 30 or 45 degree increments, etc.). Further, in some embodiments, rotational position may be controlled using time and programming logic, e.g., relative to a home position, and in some instances without feedback from a motor or position sensor. Position sensor 122 may also be external to tubular spray element drive 102 in some embodiments.

An internal passage 124 in tubular spray element 100 is in fluid communication with an internal passage 126 leading to port 108 (not shown in FIG. 4) in tubular spray element drive 102 through a rotary coupling 128. In one example implementation, coupling 128 is formed by a bearing 130 mounted in passageway 126, with one or more deformable tabs 134 disposed at the end of tubular spray element 100 to secure tubular spray element 100 to tubular spray element drive 102. A seal 132, e.g., a lip seal, may also be formed between tubular spray element 100 and tubular spray element drive 102. Other manners of rotatably coupling the tubular spray element while providing fluid flow may be used in other embodiments.

Figure 5:
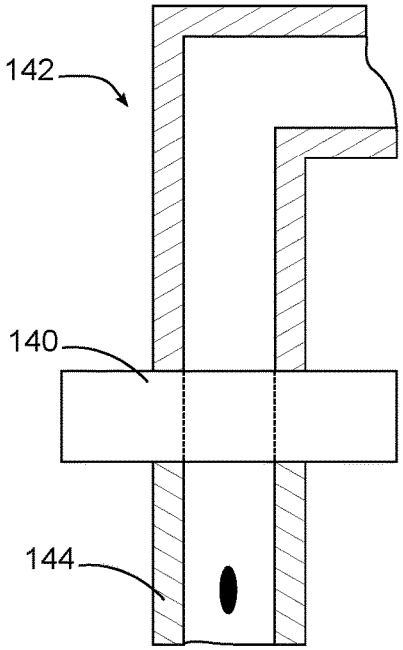
FIG. 5 is a partial cross-sectional view of another tubular spray element and tubular spray element drive consistent with some embodiments of the invention, and including a valve for restricting flow to the tubular spray element.

Turning to FIG. 5, it also may be desirable in some embodiments to incorporate a valve 140 into a tubular spray element drive 142 to regulate the fluid flow to a tubular spray element 144 (other elements of drive 142 have been omitted from FIG. 5 for clarity). Valve 140 may be an on/off valve in some embodiments or may be a variable valve to control flow rate in other embodiments. In still other embodiments, a valve may be external to or otherwise separate from a tubular spray element drive, and may either be dedicated to the tubular spray element or used to control multiple tubular spray elements. Valve 140 may be integrated with or otherwise proximate a rotary coupling between tubular spray element 144 and tubular spray element drive 142. By regulating fluid flow to tubular spray elements, e.g., by selectively shutting off tubular spray elements, water can be conserved and/or high-pressure zones can be created by pushing all of the hydraulic power through fewer numbers of tubular spray elements.

In some embodiments, valve 140 may be actuated independent of rotation of tubular spray element 144, e.g., using an iris valve, butterfly valve, gate valve, plunger valve, piston valve, valve with a rotatable disc, ball valve, etc., and actuated by a solenoid, motor or other separate mechanism from the mechanism that rotates tubular spray element 144. In other embodiments, however, valve 140 may be actuated through rotation of tubular spray element 144. In some embodiments, for example, rotation of tubular spray element 144 to a predetermined rotational position may be close valve 140, e.g., where valve 140 includes an arcuate channel that permits fluid flow over only a range of rotational positions.

Figure 6:
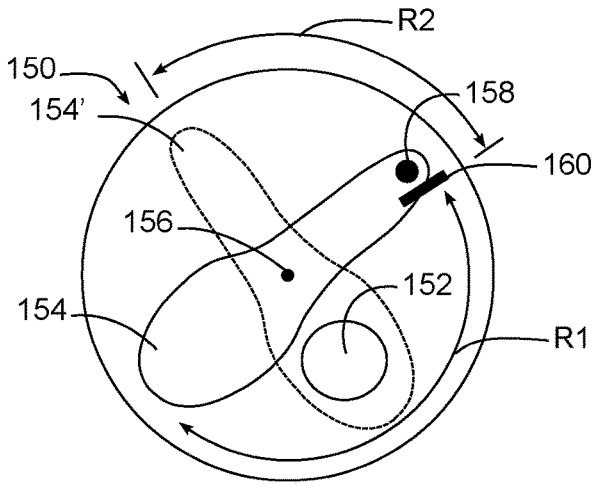
FIG. 6 is one example implementation of the valve referenced in FIG. 5.

As another example, and as illustrated by valve 150 of FIG. 6, a valve may be actuated through over-rotation of a tubular spray element. Valve 150, for example, includes a port 152 that is selectively shut by a gate 154 that pivots about a pin 156. Gate 154 is biased (e.g., via a spring) to the position shown via solid line in FIG. 6, and includes a leg 158 that selectively engages a stop 160 at a predetermined rotational position representing an end of a range R1 of active spray positions for the tubular spray element. When a tubular spray element is rotated beyond range R1, e.g., within range R2, leg 158 engages with stop 160 to pivot gate 154 to the position 154' shown in dotted line and seal port 152.

Figure 7:
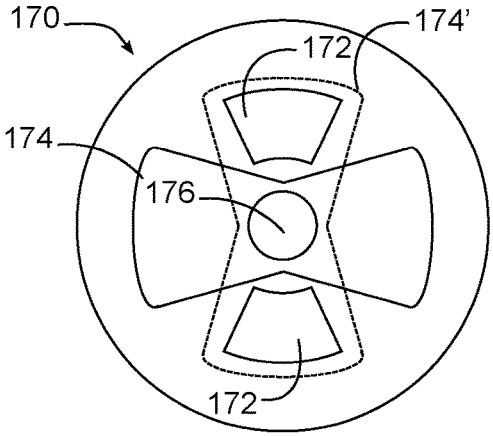
FIG. 7 is another example implementation of the valve referenced in FIG. 5.

As yet another example, and as illustrated by valve 170 of FIG. 7, a valve may be actuated through counter rotation of a tubular spray element. Valve 170, for example, includes a pair of ports 172 that are selectively shut by a gate 174 that pivots about a one way bearing 176. Gate 174 is biased (e.g., via a spring) to the position shown via solid line in FIG. 7, and when the tubular spray element is rotated in a clockwise direction, gate 174 is maintained in a position that permits fluid flow through ports 172. Upon counter-clockwise rotation, however, gate 174 is rotated to position 174' shown in dotted line to seal ports 172 through the action of one way bearing 176.

Figure 8:
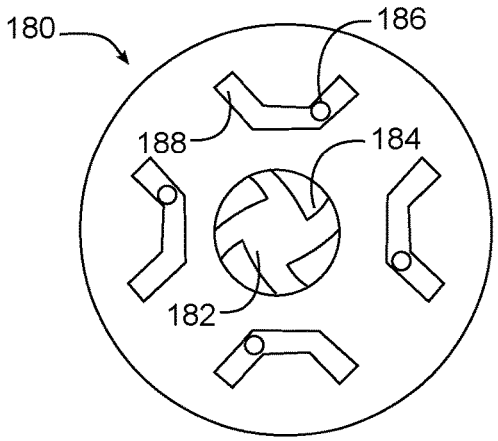
FIG. 8 is yet another first example implementation of the valve referenced in FIG. 5.

As yet another example, and as illustrated by valve 180 of FIG. 8, a valve 180 may be a variable valve, e.g., an iris valve, including a port 182 that is selectively regulated by a plurality of iris members 184. Each iris member 184 includes a pin 186 that rides in a track 188 to vary an opening size of port 182. Valve 180 may be independently actuated from rotation of a tubular spray element in some embodiments (e.g., via a solenoid or motor), or may be actuated through rotation of a tubular spray element, e.g., through rotation to a predetermined position, an over-rotation, or a counter-rotation, using appropriate mechanical linkages.

It should also be noted that with the generally U-shape of track 188, valve 180 may be configured in some embodiments to close through counter-rotation by a predetermined amount, yet still remain open when rotated in both directions. Specifically, valve 180 may be configured such that, the valve is open when pin 186 is disposed in either leg of the U-shaped track, but is closed when pin 186 is disposed in the central portion of the track having the shortest radial distance from the centerline of the valve. Valve 180 may be configured such that, when the tubular spray element is rotating in one direction and pin 186 is disposed at one end of track 188, the valve is fully open, and then when the tubular spray element is counter-rotated in an opposite direction a first predetermined amount (e.g., a predetermined number of degrees) the pin 186 travels along track 188 to the central portion to fully close the valve. Then, when the tubular spray element is counter-rotated in the opposite direction beyond the first predetermined about, the pin 186 continues to travel along track 188 to the opposite end, thereby reopening the valve such that the valve will remain open through continued rotation in the opposite direction.

Figure 9:
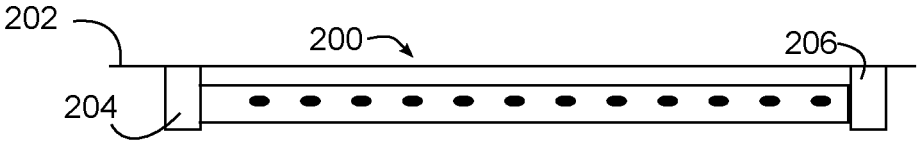
FIG. 9 is a functional top plan view of an example implementation of a wall-mounted tubular spray element and tubular spray element drive consistent with some embodiments of the invention.
Figure 10:
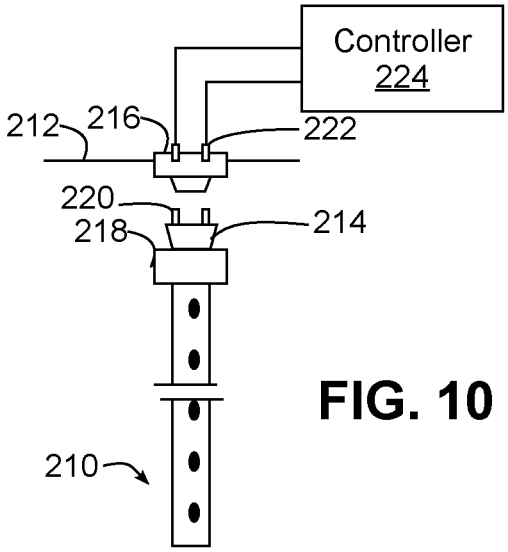
FIG. 10 is a functional top plan view of an example implementation of a rack-mounted tubular spray element and tubular spray element drive consistent with some embodiments of the invention.
Figure 11:
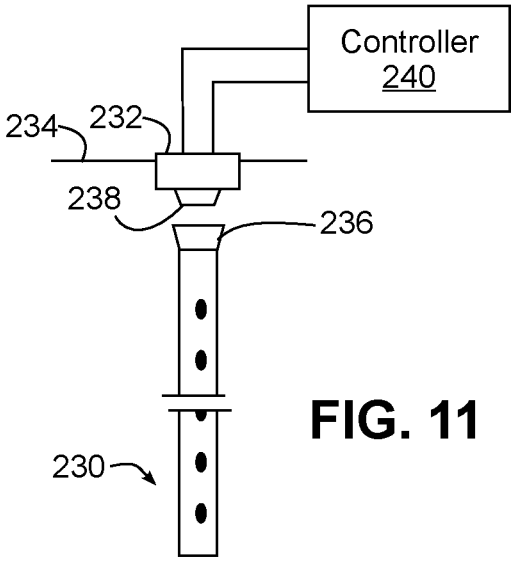
FIG. 11 is a functional top plan view of another example implementation of a rack-mounted tubular spray element and tubular spray element drive consistent with some embodiments of the invention.

Now turning to FIGS. 9-11, tubular spray elements may be mounted within a wash tub in various manners in different embodiments. As illustrated by FIGS. 1 and 3 (discussed above), a tubular spray element in some embodiments may be mounted to a wall (e.g., a side wall, a back wall, a top wall, a bottom wall, or a door) of a wash tub, and may be oriented in various directions, e.g., horizontally, vertically, front-to-back, side-to-side, or at an angle. It will also be appreciated that a tubular spray element drive may be disposed within a wash tub, e.g., mounted on wall of the wash tub or on a rack or other supporting structure, or alternatively some or all of the tubular spray element drive may be disposed external from a wash tub, e.g., such that a portion of the tubular spray element drive or the tubular spray element projects through an aperture in the wash tub. Alternatively, a magnetic drive could be used to drive a tubular spray element in the wash tub using an externally-mounted tubular spray element drive.

Moreover, as illustrated by tubular spray element 200 of FIG. 9, rather than being mounted in a cantilevered fashion as is the case with tubular spray element 100 of FIG. 3, a tubular spray element may also be mounted on a wall 202 of a wash tub and supported at both ends by hubs 204, 206, one or both of which may include the components of the tubular spray element drive. In this regard, the tubular spray element 200 runs generally parallel to wall 202 rather than running generally perpendicular thereto, as is the case with tubular spray element 100 of FIG. 3.

In still other embodiments, a tubular spray element may be rack-mounted. FIG. 10, for example, illustrates a tubular spray element 210 mountable on rack (not shown) and dockable via a dock 214 to a docking port 216 on a wall 212 of a wash tub. In this embodiment, a tubular spray element drive 218 is also rack-mounted, and as such, in addition to a fluid coupling between dock 214 and docking port 216, a plurality of cooperative contacts 220, 222 are provided on dock 214 and docking port 216 to provide power to tubular spray element drive 218 as well as electrical communication with a controller 224.

As an alternative, and as illustrated in FIG. 11, a tubular spray element 230 may be rack-mounted, but separate from a tubular spray element drive 232 that is not rack-mounted, but is instead mounted to a wall 234 of a wash tub. A dock 236 and docking port 238 provide fluid communication with tubular spray element 230, along with a capability to rotate tubular spray element 230 about its longitudinal axis under the control of tubular spray element drive 232. Control over tubular spray element drive 232 is provided by a controller 240. In some instances, tubular spray element drive 232 may include a rotatable and keyed channel into which an end of a tubular spray element may be received.

Figure 12:
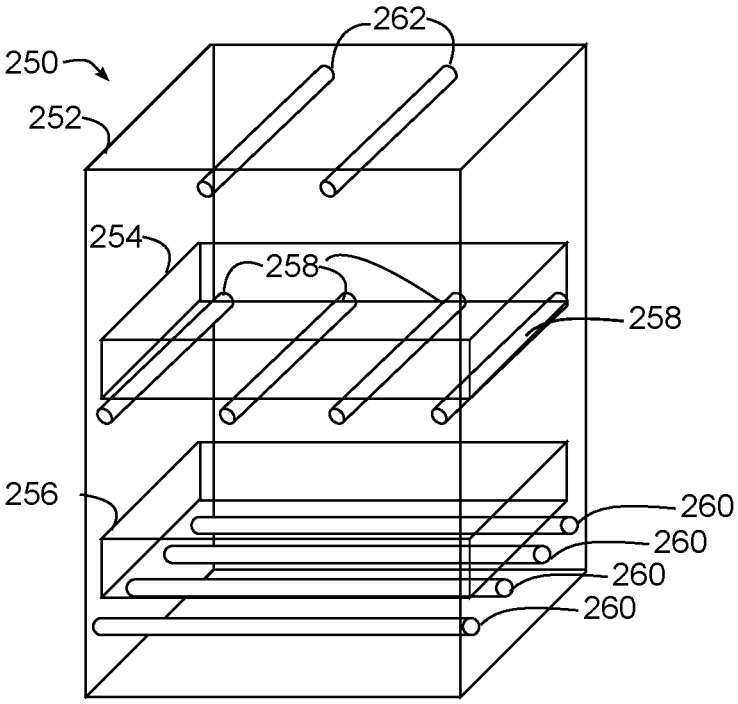
FIG. 12 is a functional perspective view of a dishwasher incorporating multiple tubular spray elements and consistent with some embodiments of the invention.

FIG. 12 next illustrates a dishwasher 250 including a wash tub 252 and upper and lower racks 254, 256, and with a number of tubular spray elements 258, 260, 262 distributed throughout the wash tub 252 for circulating a wash fluid through the dishwasher. Tubular spray elements 258 may be rack-mounted, supported on the underside of upper rack 254, and extending back-to-front within wash tub 252. Tubular spray elements 258 may also dock with back wall-mounted tubular spray element drives (not shown in FIG. 12), e.g., as discussed above in connection with FIG. 11. In addition, tubular spray elements 258 may be rotatably supported at one or more points along their respective longitudinal axes by couplings (not shown) suspended from upper rack 254. Tubular spray elements 258 may therefore spray upwardly into upper rack 254 and/or downwardly onto lower rack 256, and in some embodiments, may be used to focus wash fluid onto a silverware basket or other region of either rack to provide for concentrated washing. Tubular spray elements 260 may be wall-mounted beneath lower rack 256, and may be supported at both ends on the side walls of wash tub 252 to extend in a side-to-side fashion, and generally transverse to tubular spray elements 258. Each tubular spray element 258, 260 may have a separate tubular spray element drive in some embodiments, while in other embodiments some or all of the tubular spray elements 258, 260 may be mechanically linked and driven by common tubular spray element drives.

In some embodiments, tubular spray elements 258, 260 by themselves may provide sufficient washing action and coverage. In other embodiments, however, additional tubular spray elements, e.g., tubular spray elements 262 supported above upper rack 254 on one or both of the top and back walls of wash tub 252, may also be used. In addition, in some embodiments, additional spray arms and/or other sprayers may be used. It will also be appreciated that while 10 tubular spray elements are illustrated in FIG. 12, greater or fewer numbers of tubular spray elements may be used in other embodiments.

It will also be appreciated that in some embodiments, multiple tubular spray elements may be driven by the same tubular spray element drive, e.g., using geared arrangements, belt drives, or other mechanical couplings. Further, tubular spray elements may also be movable in various directions in addition to rotating about their longitudinal axes, e.g., to move transversely to a longitudinally axis, to rotate about an axis of rotation that is transverse to a longitudinal axis, etc. In addition, deflectors may be used in combination with tubular spray elements in some embodiments to further the spread of fluid and/or prevent fluid from hitting tub walls. In some embodiments, deflectors may be integrated into a rack, while in other embodiments, deflectors may be mounted to a wall of the wash tub. In addition, deflectors may also be movable in some embodiments, e.g., to redirect fluid between multiple directions. Moreover, while in some embodiments tubular spray elements may be used solely to spray wash fluid, in other embodiments tubular spray elements may be used to spray pressurized air at utensils during a drying operation of a wash cycle, e.g., to blow off water that pools on cups and dishes after rinsing is complete. In some instances, different tubular spray elements may be used to spray wash fluid and spray pressurized air, while in other instances the same tubular spray elements may be used to alternately or concurrently spray wash liquid and pressurized air.

Wall-Mounted Rotatable Conduit

Figure 13:
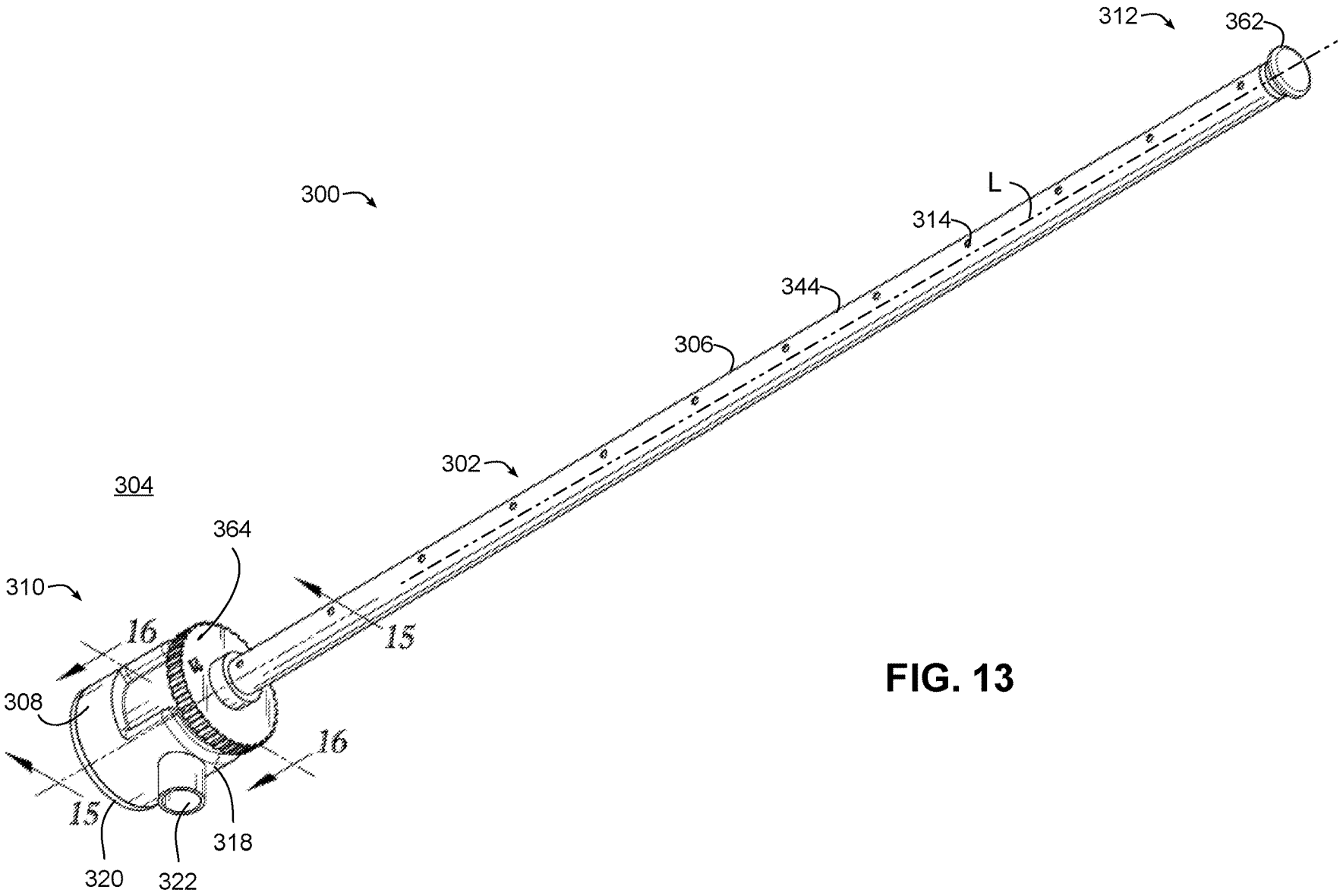
FIG. 13 is a perspective view of an example implementation of wall-mounted rotatable conduit consistent with some embodiments of the invention.

Now turning to FIGS. 13-17, and initially with reference to FIG. 13, an example dishwasher 300 is illustrated including a wall-mounted sprayer 302 disposed on a wall 304 of a wash tub of dishwasher 300. Sprayer 302 includes a rotatable conduit 306 that is rotatably supported in a cantilevered fashion to rotate about a longitudinal axis L by a wall-mounted conduit support 308 at a first end 310 thereof, such that an opposite second end 312 of rotatable conduit 306 is unsupported.

In the illustrated embodiment, rotatable conduit 306 is used as a spray element, and as such, includes a plurality of apertures 314 defined in a sidewall thereof and from which fluid conveyed into an internal channel of the rotatable conduit exits to direct a spray of fluid onto utensils within dishwasher 300. In some embodiments, rotatable conduit 306 may be implemented as a tubular spray element capable of being discretely directed to various rotational positions about longitudinal axis L. In other embodiments, however, rotatable conduit 306 may omit apertures altogether, or may include various alternate configurations of apertures, nozzles and/or other types of spray elements. Moreover, rotatable conduit 306 may be configured to rotate without being discretely directed, e.g., based upon torque generated by fluid exiting the apertures of the rotatable conduit.

It will be appreciated that in part due to the cantilevered nature of rotatable conduit 306, providing adequate support for rotatable conduit 306 while also providing low-friction rotation of rotatable conduit 306, and doing so in a cost-effective manner, is highly desirable. In some embodiments consistent with the invention, and with additional reference to FIGS. 14 and 15, one or more bearing arrangements 326, 328 may be used in combination with a shoulder 316 on rotatable conduit 306 that inhibits axial movement (i.e., movement along longitudinal axis L) of rotatable conduit 306 within conduit support 308. By doing so, rotatable conduit 306 may be supported in a cantilevered and rotatable fashion on a wall of a dishwasher tub.

Conduit support 308 includes a housing 318 along with a rear cover 320 that seal first end 310 of rotatable conduit 306 within conduit support 308. Conduit support 308 also includes a fluid inlet 322 that is in fluid communication with a fluid supply (e.g., a pump 36 and/or air supply 38 as illustrated in FIG. 2), and conduit support 308 is configured to communicate fluid from the fluid supply to rotatable conduit 306.

Conduit support 308 also includes an aperture 324 through which rotatable conduit 306 projects, and conduit support 308 is configured to retain shoulder 316 of rotatable conduit 306 within conduit support 308 to inhibit axial movement of the rotatable conduit within the conduit support. The conduit support also incorporates bearing arrangements 326, 328 that include respective bearings 330, 332, each having a respective aperture 334, 336 through which rotatable conduit 306 projects.

As noted above, in some implementations conduit support 308 may also incorporate a diverter valve that selectively controls fluid flow to rotatable conduit 306 based upon a rotational position of the rotatable conduit, i.e., so that fluid flow is controllably allowed or restricted at one or more predetermined rotational positions of the rotatable conduit. In the illustrated embodiment, a valve body 338 having an aperture 340 through which rotatable conduit 306 projects includes an inlet 342 that is configured as a radially-facing inlet insofar as the inlet faces generally in a radial direction from longitudinal axis L. Also, in this embodiment, rotatable conduit 306 is formed from a substantially-cylindrical metal tube 344, and valve body 338 is configured to fasten to metal tube 344 using a fastener 346, e.g., a pin or set screw, to restrict relative rotation between metal tube 344 and valve body 338. An inlet port 348 is formed in a sidewall of metal tube 344 and is aligned with inlet 342 such that fluid entering inlet 342 may be conveyed through inlet port 348 into the internal channel of the metal tube. A plug 350 is also press-fit into first end 310 of rotatable conduit 306 to block fluid flow out of the first end. It will be appreciated, however, that in other embodiments, rotatable conduit 306 may incorporate other designs, and may be constructed of other materials. In some embodiments, for example, valve body 338 may be integrally formed, or if separately formed, may be secured in other manners. Furthermore, rotatable conduit 306 may include a non-circular cross-section and/or may have a cross-section that varies over its length. In addition, first end 310 may be sealed in other manners, e.g., if rotatable conduit 306 is formed with a closed end.

To support rotatable conduit 306 in rotatable support 308, a pair of axially-separated annular bearing supports 352, 354 are respectively formed in cover 320 and housing 318 to receive bearings 330, 332 in an axially-separated relationship with valve body 338 interposed therebetween. In the illustrated embodiment, bearings 330, 332 are each rolling element bearings such as ball bearings or roller bearings, although the invention is not so limited. In other embodiments, one or both of bearings 330, 332 may be implemented as slip, sleeve or plain bearings, incorporating plastic, metal or other surfaces that allow for rotatable support of rotatable conduit 306. In some embodiments, for example, a bearing surface may be integrally formed on housing 318 and/or cover 320 to rotatably support rotatable conduit 306. Thus, in some embodiments, two rolling element bearings may be used, two bearing surfaces may be used, or one rolling element bearing and one bearing surface may be used. In other embodiments, other bearing arrangements may be used, and it will be appreciated that greater or fewer bearing arrangements may be used to rotatably support rotatable conduit 306.

Conduit support 308 also includes a radially-facing valve member 358 that effectively operates to selectively restrict fluid flow through inlet 342 of valve body 338 when rotatable conduit 306 is rotated to a predetermined rotational position. As illustrated in particular in FIG. 16, radially-facing valve member 358 is disposed at a predetermined radius R from longitudinal axis L to substantially block fluid flow from fluid inlet 322 to radially-facing inlet 342 when rotatable conduit 306 is rotated to a rotational position that orients inlet 342 directly opposite valve member 358.

Figure 17:
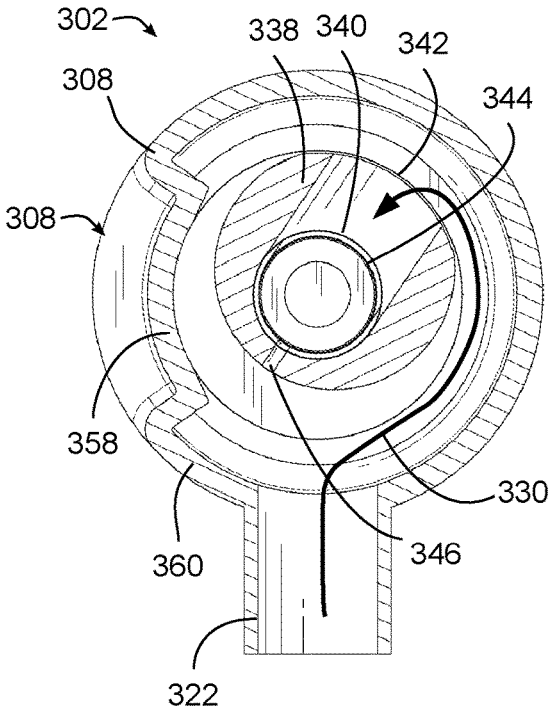
FIG. 17 is a similar cross-sectional view of the wall-mounted rotatable conduit of FIG. 16, and illustrating the wall-mounted rotatable conduit rotated to an open rotational position.

In contrast, when rotatable conduit 306 is rotated to a different rotational position, e.g., as illustrated in FIG. 17, an interior wall 360 of conduit support 308 is radially-separated from radially-facing inlet 342 to allow fluid flow from fluid inlet 322 to the radially-facing inlet 342. It should also be noted that while in other embodiments a non-cammed body may be used for valve body 338, in the illustrated embodiment valve body 338 is implemented as a cam body and thereby increases the internal volume surrounding the valve body within housing 318.

Returning to FIGS. 14 and 15, shoulder 316 in some embodiments may be formed as a flared end. For example, where rotatable conduit 306 includes a substantially cylindrical metal tube 344, shoulder 316 may be flared at about a 45 degree angle in some embodiments, although other angles may be used. Other manners of forming shoulder 316 may also be used in other embodiments, e.g., by integrally forming the shoulder on the rotatable conduit, or by utilizing a separate component mounted thereto. Shoulder 316 may also be disposed proximate to, but not precisely at, first end 310 in some embodiments. It is also desirable in some embodiments for at least bearing 330, and in some instances, one or both of bearing 332 and valve body 338 to have respective apertures 334, 336 and 340 that are of smaller diameters that shoulder 316. Further, in some embodiments, it may be desirable for shoulder 316 to also have a larger diameter than aperture 324 in housing 318 of conduit support 308.

Notably, when assembled, bearings 330 and 332 and valve body 338 are effectively stacked onto rotatable conduit 306 and trapped between shoulder 316 and aperture 324 of housing 318 when rotatable conduit 306 is inserted through aperture 324. In turn, cover 320 is used to cover and seal a wall-facing opening 356 of housing 318 and engage with first end 310 of rotatable conduit 306 to inhibit axial movement of rotatable conduit 306 within conduit support 308.

Figure 14:
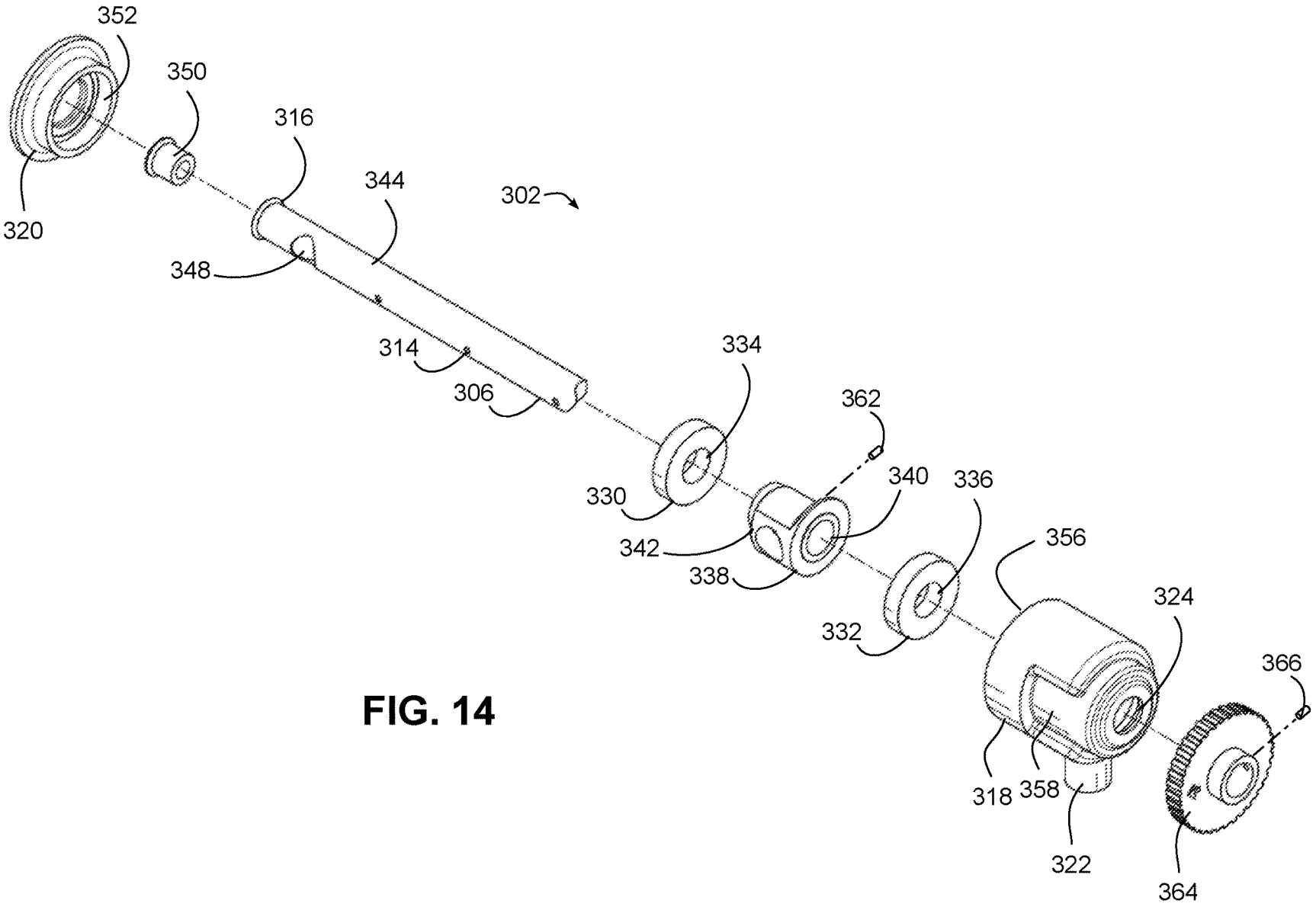
FIG. 14 is an exploded perspective view of the wall-mounted rotatable conduit of FIG. 13.
Figure 15:
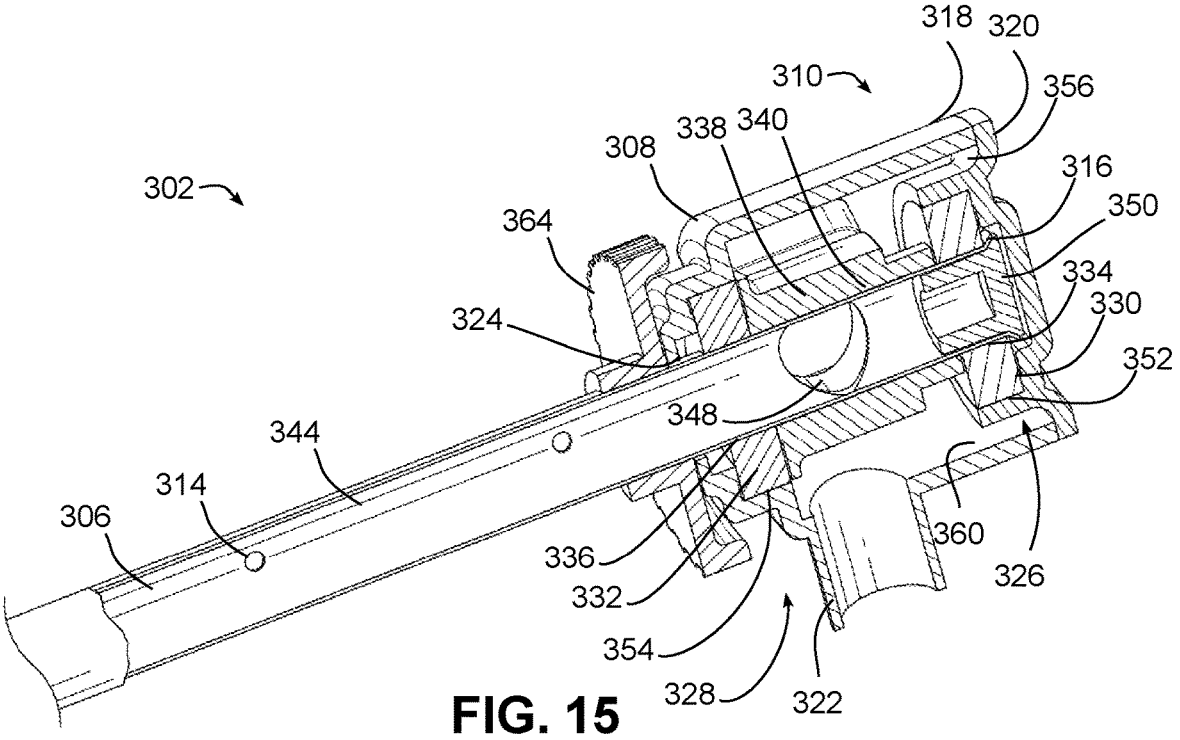
FIG. 15 is a cross-sectional view of the wall-mounted rotatable conduit of FIG. 13, taken through lines 15-15 thereof.
Figure 16:
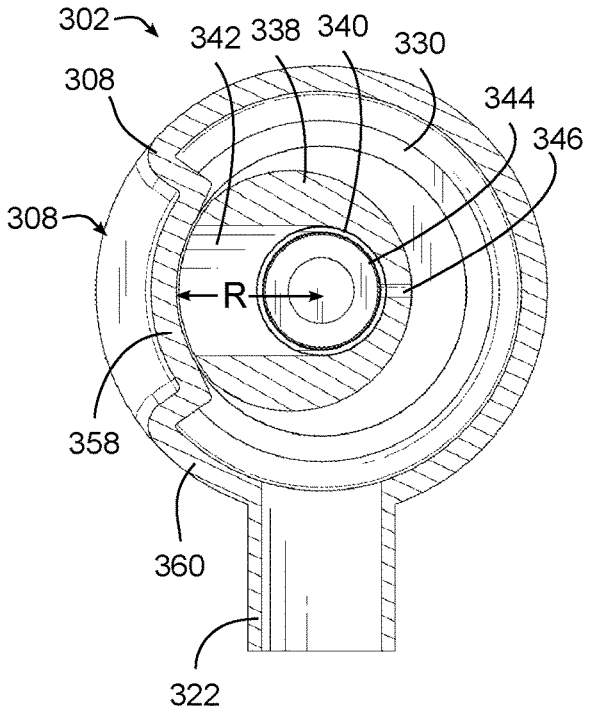
FIG. 16 is a cross-sectional view of the wall-mounted rotatable conduit of FIG. 13, taken through lines 16-16 thereof, and illustrating the wall-mounted rotatable conduit rotated to a closed rotational position.

Returning to FIG. 13, when rotatable conduit 306 is implemented using a metal tube 344, it may be desirable to use a cap 362 or other closure to seal second end 312. In other embodiments, second end 312 may be formed with a sealed end. In addition, and with reference to FIGS. 13-15, in embodiments where rotatable conduit 306 is implemented as a tubular spray element, it may be desirable in some embodiments to utilize a drive mechanism incorporating a gear 364 to mechanically couple the rotatable conduit to a tubular spray element drive. As illustrated in FIG. 14, gear 364 may be fastened to rotatable conduit 306 using a fastener 366, e.g., a pin or set screw, to restrict relative rotation between rotatable conduit 306 and gear 364. In some embodiments, gear 364 may also serve to inhibit axial movement of rotatable conduit 306 within conduit support 308.

Figure 18:
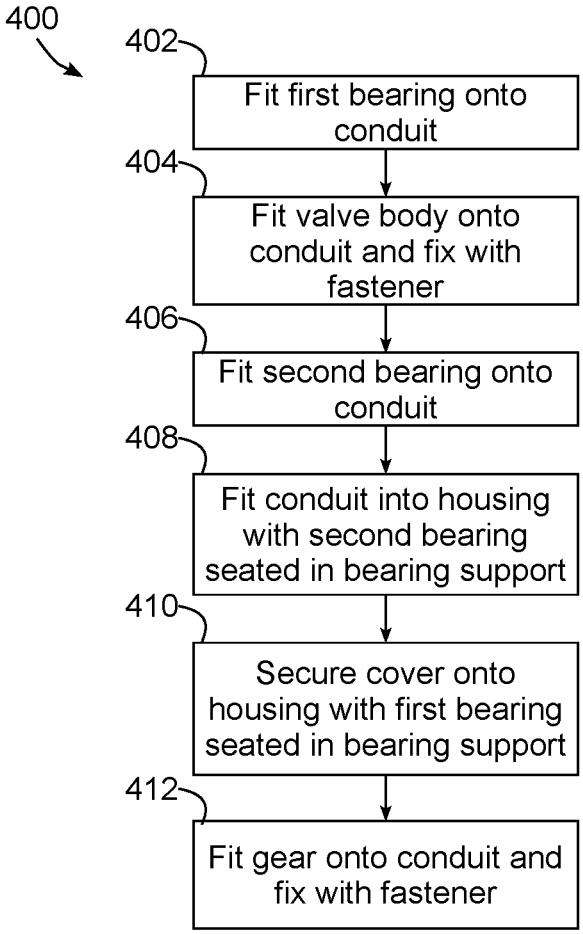
FIG. 18 is a flowchart illustrating an example sequence of operations for assembling the wall-mounted rotatable conduit.

Now turning to FIG. 18, and with additional reference to FIG. 14, assembly of sprayer 302 may be performed using a sequence of operations 400 that begins in block 402 by fitting a first bearing (bearing 330) onto rotatable conduit 306 adjacent shoulder 316, e.g., by sliding bearing 330 onto second end 312 of rotatable conduit 306 as far as it will go. It will be appreciated that because aperture 334 of bearing 330 is smaller in diameter than shoulder 316, shoulder 316 inhibits movement of bearing 330 beyond the shoulder.

Next, in block 404, valve body 338 is fit onto rotatable conduit adjacent bearing 330, e.g., by sliding valve body 338 onto second end 312 of rotatable conduit 306 as far as it will go. Then, valve body 338 may be rotated to align its radially-facing inlet 342 with inlet port 348 of rotatable conduit 306 and fastener 346 may be used to secure the valve body to the rotatable conduit. Next, in block 406, a second bearing (bearing 332) may be fit onto rotatable conduit 306 adjacent valve body 338, e.g., by sliding bearing 332 onto second end 312 of rotatable conduit 306 as far as it will go. As such, bearing 330, valve body 338 and bearing 332 are effectively stacked onto rotatable conduit 306, with bearing 330 disposed closest to shoulder 316 and bearing 332 disposed farthest from shoulder 316.

Next, in block 408, rotatable conduit 306 may be fit into housing 318 by projecting second end 312 from wall-facing opening 356 and through aperture 324 until bearing 332 seats in annular bearing support 354. Then, in block 410, cover 320 may be secured onto housing 318 (e.g., using fasteners such as screws or bolts, using tabs and locks, using adhesives or welds, or in other manners that will be appreciated by those of ordinary skill having the benefit of the instant disclosure), and with bearing 330 seated in annular bearing support 352. Next, in block 412, gear 364 may be fit onto rotatable conduit 306, e.g., by sliding gear 364 onto second end 312 of rotatable conduit 306 as far as it will go, and then secured with fastener 336.

Other modifications may be made to the illustrated embodiments without departing from the spirit and scope of the invention. For example, while conduit support 308 is illustrated as supporting and supplying fluid to a single rotatable conduit 306, in other embodiments, a conduit support may support and/or supply fluid to multiple rotatable conduits. Various additional modifications may be made to the illustrated embodiments consistent with the invention. Therefore, the invention lies in the claims hereinafter appended.

What is claimed is:

1. A dishwasher, comprising:

a wash tub;

a rack supported in the wash tub and movable between loading and washing positions;

a rotatable conduit being rotatable about a longitudinal axis thereof and including a shoulder disposed proximate a first end thereof, wherein the rotatable conduit comprises a metal tube and the shoulder is defined by a flared end integrally formed on the metal tube; and a conduit support supported and disposed on a wall of the wash tub and configured to support the rotatable conduit on the wall of the wash tub in a cantilevered fashion proximate to and separate from the rack, the conduit support including a fluid inlet in fluid communication with a fluid supply and configured to communicate fluid from the fluid supply to the rotatable conduit, wherein the conduit support includes an aperture through which the rotatable conduit projects, and wherein the conduit support is configured to retain the shoulder of the rotatable conduit within the housing to inhibit axial movement of the rotatable conduit within the conduit support.

2. The dishwasher of claim 1, wherein the flared end is flared about 45 degrees from the longitudinal axis of the rotatable conduit.

3. The dishwasher of claim 1, wherein the rotatable conduit further comprises a plug disposed in the flared end of the metal tube.

4. The dishwasher of claim 1, wherein the conduit support includes a bearing arrangement sized and configured to rotatably support the metal tube of the rotatable conduit proximate the first end thereof.

5. The dishwasher of claim 4, wherein the bearing arrangement is a first bearing arrangement, and wherein the conduit support includes a second bearing arrangement axially separated from the first bearing arrangement along the longitudinal axis and sized and configured to rotatably support the metal tube of the rotatable conduit proximate the first end thereof.

6. The dishwasher of claim 5, wherein each of the first and second bearing arrangements comprises a rolling element bearing.

7. The dishwasher of claim 5, wherein each of the first and second bearing arrangements comprises a bearing surface.

8. The dishwasher of claim 5, wherein the first bearing arrangement comprises a rolling element bearing and the second bearing arrangement comprises a bearing surface.

9. The dishwasher of claim 5, wherein the rotatable conduit further includes a valve body having a radially-facing inlet in fluid communication with an internal channel of the rotatable conduit, the valve body sized and configured to be supported on the metal tube of the rotatable conduit between the first and second bearing arrangements.

10. The dishwasher of claim 1, wherein the rotatable conduit further includes a valve body having a radially-facing inlet in fluid communication with an internal channel of the rotatable conduit, and wherein the conduit support includes a radially-facing valve member disposed at a predetermined radius from the longitudinal axis to substantially block fluid flow from the inlet of the conduit support to the radially-facing inlet when the rotatable conduit is rotated to a predetermined rotational position about the longitudinal axis.

11. The dishwasher of claim 1, wherein the rotatable conduit includes a plurality of apertures disposed in a sidewall thereof to spray fluid into the wash tub.

12. The dishwasher of claim 11, wherein the conduit comprises a tubular spray element, and wherein the dishwasher further comprises a tubular spray element drive coupled to the rotatable conduit to discretely direct the rotatable conduit to each of a plurality of rotational positions about the longitudinal axis thereof.

13. A dishwasher, comprising:

a wash tub;

a rotatable conduit being rotatable about a longitudinal axis thereof and including a shoulder disposed proximate a first end thereof; and a conduit support disposed on a wall of the wash tub and configured to support the rotatable conduit on the wall of the wash tub in a cantilevered fashion, the conduit support including a fluid inlet in fluid communication with a fluid supply and configured to communicate fluid from the fluid supply to the rotatable conduit, wherein the conduit support includes an aperture through which the rotatable conduit projects, and wherein the conduit support is configured to retain the shoulder of the rotatable conduit within the housing to inhibit axial movement of the rotatable conduit within the conduit support;

wherein the rotatable conduit further includes a valve body having a radially-facing inlet in fluid communication with an internal channel of the rotatable conduit, and wherein the conduit support includes a radially-facing valve member disposed at a predetermined radius from the longitudinal axis to substantially block fluid flow from the inlet of the conduit support to the radially-facing inlet when the rotatable conduit is rotated to a predetermined rotational position about the longitudinal axis; and wherein the predetermined rotational position is a first predetermined rotational position, and wherein the conduit support includes a housing having an interior wall disposed proximate the valve body that is radially-separated from the radially-facing inlet when the rotatable conduit is rotated to a second predetermined rotational position about the longitudinal axis to allow fluid flow from the inlet of the conduit support to the radially-facing inlet when the rotatable conduit is rotated to the second predetermined rotational position.

14. The dishwasher of claim 13, wherein the housing includes an annular bearing support disposed proximate the aperture and sized to receive a rolling element bearing having an aperture through which the rotatable conduit projects.

15. The dishwasher of claim 14, wherein the conduit support further comprises a cover configured to cover and seal a wall-facing opening of the housing.

16. The dishwasher of claim 15, wherein the annular bearing support is a first annular bearing support and the rolling element bearing is a first rolling element bearing, and wherein the cover includes a second annular bearing support configured to receive a second rolling element bearing having an aperture through which the rotatable conduit projects, and wherein the cover inhibits axial movement of the rotatable conduit within the conduit support.

17. The dishwasher of claim 16, wherein the rotatable conduit includes a substantially cylindrical tube having an inlet port disposed in a sidewall thereof, wherein the valve body comprises a cam body having an aperture, and wherein the cam body is interposed between the first and second rolling element bearings with the generally cylindrical tube extending through the apertures thereof.

18. A dishwasher, comprising:

a wash tub;

a rack supported in the wash tub and movable between loading and washing positions;

a rotatable conduit being rotatable about a longitudinal axis thereof and including a shoulder disposed proximate a first end thereof; and a conduit support supported and disposed on a wall of the wash tub and configured to support the rotatable conduit on the wall of the wash tub in a cantilevered fashion proximate to and separate from the rack, the conduit support including a fluid inlet in fluid communication with a fluid supply and configured to communicate fluid from the fluid supply to the rotatable conduit, wherein the conduit support includes an aperture through which the rotatable conduit projects, wherein the conduit support is configured to retain the shoulder of the rotatable conduit within the housing to inhibit axial movement of the rotatable conduit within the conduit support, wherein the conduit support includes a bearing arrangement configured to rotatably support the rotatable conduit proximate the first end thereof, and wherein the bearing arrangement comprises a rolling element bearing.

* * * * *